US009312608B2

(12) United States Patent
Tang et al.

(10) Patent No.: US 9,312,608 B2
(45) Date of Patent: Apr. 12, 2016

(54) MULTIPLE-INPUT MULTIPLE-OUTPUT ANTENNA DEVICE

(71) Applicant: TAI-SAW TECHNOLOGY CO., LTD., Taoyuan County (TW)

(72) Inventors: Tzu-Chun Tang, Taoyuan County (TW); Ken-Huang Lin, Taoyuan County (TW)

(73) Assignee: TAI-SAW TECHNOLOGY CO, LTD, Taoyuan (TW)

( * ) Notice: Subject to any disclaimer, the term of this patent is extended or adjusted under 35 U.S.C. 154(b) by 324 days.

(21) Appl. No.: 13/863,900

(22) Filed: Apr. 16, 2013

(65) Prior Publication Data

US 2013/0271345 A1 Oct. 17, 2013

(30) Foreign Application Priority Data

Apr. 17, 2012 (TW) ..... 101113674 A

(51) Int. Cl.
*H01Q 21/00* (2006.01)
*H01Q 1/52* (2006.01)
*H01Q 5/48* (2015.01)

(52) U.S. Cl.
CPC ..... *H01Q 21/0075* (2013.01); *H01Q 1/521* (2013.01); *H01Q 5/48* (2015.01); *H01Q 21/0093* (2013.01); *Y10T 29/49016* (2015.01)

(58) Field of Classification Search
CPC ... H01Q 1/521; H01Q 1/526; H01Q 21/0075; H01Q 21/0093; Y10T 29/49016
USPC ..... 343/702, 893, 841; 29/600
See application file for complete search history.

(56) References Cited

U.S. PATENT DOCUMENTS

2010/0053022 A1* 3/2010 Mak et al. ..... 343/893

FOREIGN PATENT DOCUMENTS

| | | |
|---|---|---|
| TW | I255588 | 5/2006 |
| TW | M341314 | 9/2008 |
| TW | 200943627 A | 10/2009 |

OTHER PUBLICATIONS

Office Action from TW application No. 101113674 dated Mar. 27, 2014.
Office Action from TW application No. 101113674 dated Oct. 14, 2014.

* cited by examiner

*Primary Examiner* — Dieu H Duong
(74) *Attorney, Agent, or Firm* — Haverstock & Owens LLP

(57) ABSTRACT

A coplanar waveguide fed multiple-input multiple-output (MIMO) antenna device is provided in the present invention. The coplanar waveguide fed multiple-input multiple-output (MIMO) antenna device includes a grounding metal piece; a grounding plane; a first radiation element connected to the grounding plane; and a second radiation element connected to the grounding plane through the grounding metal piece.

20 Claims, 15 Drawing Sheets d = distance between the two antennas

MULTIPLE-INPUT MULTIPLE-OUTPUT ANTENNA DEVICE

FIELD OF THE INVENTION

The invention relates in general to a coplanar waveguide fed multiple-input multiple-output (MIMO) antenna and more particular to a MIMO antenna with dual frequency isolation.

BACKGROUND OF THE INVENTION

In the design for the multiple input/output system, the isolation between two antennas is closely associated to the correlation coefficient ρ in the communication system. Typically, while the smaller the correlation coefficient is, the higher the data throughput is. In general, the correlation coefficient ρ can be calculated based on the isolation between antennas and the matching through the following formula:

$$\rho = \left| \frac{|S_{11}^* S_{12} + S_{21}^* S_{22}|^2}{(1 - |S_{11}|^2 - |S_{21}|^2)(1 - |S_{22}|^2 - |S_{12}|^2)} \right|$$

wherein $S_{11}$ is the reflection coefficient of the first antenna, $S_{22}$ is the reflection coefficient of the second antenna, and $S_{12}$ and $S_{21}$ are the degree of coupling between antennas. While the smaller $S_{11}$ or $S_{22}$ is, the better the matching of the first antenna or the second antenna is. It is known from the above formula that, in order to lower the correlation coefficient of a wireless communication system, there must be good matching of each antenna unit and low coupling between the two antennas, thus the data throughput of the wireless communication system is increased.

At present, the technique to lower the correlation coefficient is to add a complicated decoupling structure or circuit between the two antennas or on the two input terminals. However, in practical application the above techniques encounter the following drawbacks: 1. Decoupling structure will cause part of the energy to concentrate on the structure (a resonator for example), thus lowering the radiation efficiency of the antennas. 2. Decoupling structure has a certain size, thus occupying a relatively big area when applied to a handheld device, and the area of a handheld device is usually limited. 3. Decoupling circuit is composed of capacitors and inductors and the passive device and circuit must be designed for a specific frequency, thus increasing the complexity and cost. The above 3 drawbacks will make the practical application of MIMO antennas to handheld devices difficult to a certain extent and increase the cost. Therefore, we provide an innovative design utilizing a grounding metal piece to control the antenna resonance patterns (antenna mode, resonant frequency) in order to increase the isolation.

Accordingly, in view of the drawbacks of conventional technology, the Applicant, through careful testing and research and a spirit of perseverance, finally conceived the present invention "MULTIPLE-INPUT MULTIPLE-OUTPUT ANTENNA DEVICE", which can overcome the above-mentioned drawbacks. The following is a concise description of the present application.

SUMMARY OF THE INVENTION

The present invention utilizes a grounding metal piece to produce different resonance patterns and corresponding current paths at high and low frequencies, and through adjusting the zero point of current, to achieve dual frequency isolation without additional structure or circuit, making the distance between the two antennas and overall size designed by the present invention smaller than those by the prior art, and the present invention applicable to dual-frequency band operation.

According to the first aspect of the present invention, a coplanar waveguide fed multiple-input multiple-output (MIMO) antenna device is provided, the device comprising: a grounding metal piece; a grounding plane; a first radiation element connected to the grounding plane; and a second radiation element connected to the grounding plane through the grounding metal piece.

According to the second aspect of the present invention, a multiple-input multiple-output antenna device is provided, the device comprising: a grounding plane; a grounding piece; and at least two antennas connected separately to the grounding plane through the grounding piece and disposed on a plane coplanar with the grounding plane.

According to the third aspect of the present invention, a multiple-input multiple-output antenna device is provided, the device comprising: a grounding plane; a short-circuiting device; and at least two antennas, wherein at least one antenna of the at least two antennas is connected to the grounding plane through the short-circuiting device, and the at least one antenna is disposed on a plane coplanar with the grounding plane.

According to the fourth aspect of the present invention, a method for manufacturing a multiple-input multiple-output antenna device is provided, the method comprising: providing a grounding plane and at least two antennas; coplanarly disposing at least one antenna of the at least two antennas and the grounding plane; and causing the at least one antenna to be short-circuited to the grounding plane.

DETAILED DESCRIPTION OF THE PREFERRED EMBODIMENT

Figure 1:
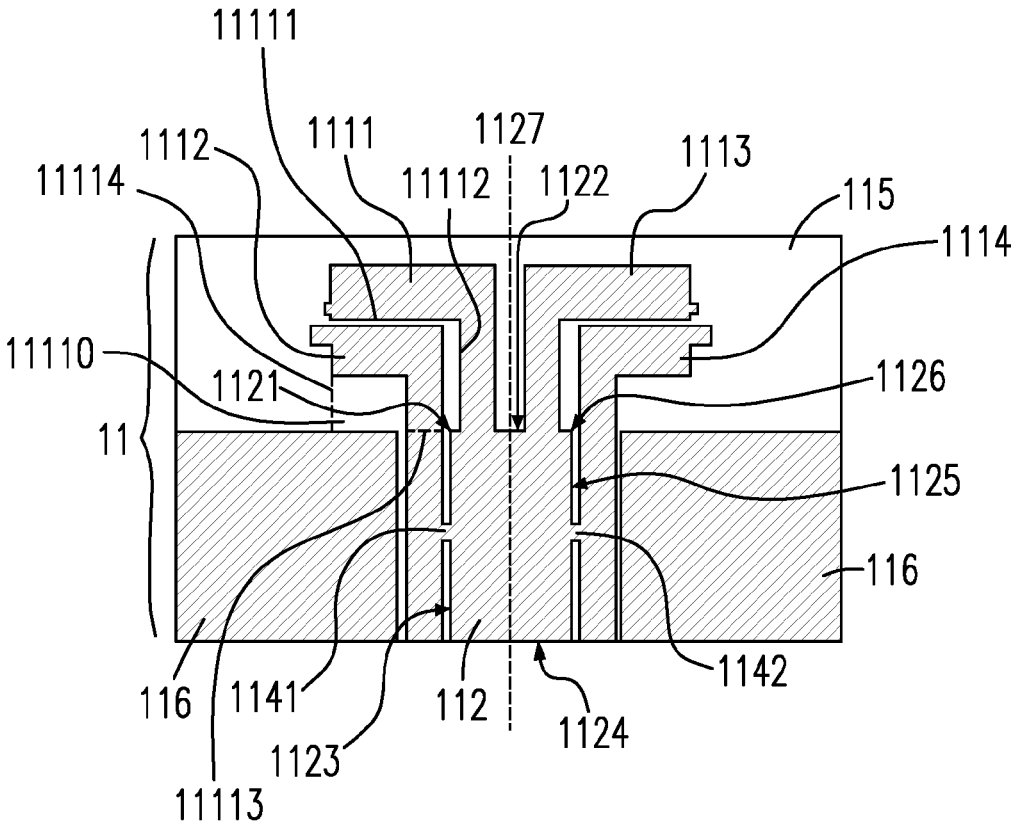
FIG. 1 is a schematic diagram illustrating a preferred embodiment in accordance with the present invention.

The present invention will now be described more specifically with reference to the following embodiments. It is to be noted that the following descriptions of preferred embodiments of this invention are presented herein for purposes of illustration and description only; it is not intended to be exhaustive or to be limited to the precise form disclosed.

While the present invention is exemplarily described by reference to the preferred embodiments and examples regarding the mutual connection of a plurality of bonding pads of a display and a plurality of bonding pads of an external circuit for performing signal exchange and communication, it is to be understood that these examples are intended in an illustrative rather than in a limiting sense. It is contemplated that modifications and combinations will readily occur to those skilled in the art, which modifications and combinations will be within the spirit of the invention.

In addition, the present invention can be fully understood from the descriptions of the following embodiments, allowing persons skilled in the art to carry out it accordingly, but the following embodiments of the invention is set forth without any loss of generality to and without imposing limitations upon, the claimed invention. The same reference numerals are used to denote the same components throughout.

FIG. 1 shows a schematic diagram illustrating a preferred embodiment for the multiple-input multiple-output (MIMO) antenna device in accordance with the present invention. A multiple-input multiple-output antenna device 11 is preferably disposed on a planar carrier and is a coplanar waveguide fed MIMO antenna device, comprising a radiating conductor 111, a grounding plane 112, a grounding plane 116, a grounding metal piece 1141 and a grounding metal piece 1142, wherein the grounding metal piece 1141 and the grounding metal piece 1142 can also be linear metal wires. The multiple-input multiple-output antenna device 11 comprises an antenna 1 and an antenna 2, wherein the antenna 1 comprises a first radiation element 1111 and a second radiation element 1112, and the antenna 2 comprises a third radiation element 1113 and a fourth radiation element 1114. The first radiation element 1111 is connected to the grounding plane 112, and the second radiation element 1112 is connected to the grounding plane 112 through the grounding metal piece 1141. Similarly, the third radiation element 1113 is connected to the grounding plane 112, and a fourth radiation element 1114 is connected to the grounding plane 112 through the grounding metal piece 1142. The first radiation element 1111, the second radiation element 1112, the third radiation element 1113 and the fourth radiation element 1114 are disposed on the planar carrier through one being selected from a group consisting of a single-sided printed circuit board, a double-sided printed circuit board and an etching bending pattern, and the planar carrier is preferably a dielectric substrate. Besides, the multiple-input multiple-output antenna device 11 also comprises an antenna input terminal 113.

The multiple-input multiple-output antenna device 11 has a lowest resonant frequency in a free space, and the grounding plane 112 preferably has a rectangular shape, a first side 1122 and a second side 1123, with the second side 1123 adjacent to the first side 1122 and forming a first angle 1121, wherein the first radiation element 1111 is connected to the first side 1122, and the second radiation element 1112 is connected (short-circuited) to the second side 1123 through the grounding metal piece 1141, with the distance between the grounding metal piece 1141 and the first angle 1121 being at least 1/61 of a wavelength in the free space corresponding to the lowest resonant frequency. And the distance between the grounding metal piece 1141 and the first angle 1121 is adjustable according to the antenna resonance patterns. Among them, the grounding metal piece 1141 has an area not exceeding ½ of that of the grounding plane 112, and the grounding metal piece 1141 preferably has a size of 2 mm×2 mm in the rectangular shape.

Each of the first radiation element 1111 and the second radiation element 1112 has an inverted L-shape. The first radiation element 1111 and the second radiation element 1112 extend in the same direction, and a portion of the second radiation element 1112 is located inside the rectangle 11110 including two adjacent sides formed by two imaginary sides 11113 and 11114, and another two adjacent sides formed by two inner adjacent edges 11111 and 11112 of the first radiation element 1111. The first radiation element 1111 and the second radiation element 1112 respectively have a dielectric substrate with a total number of layers being at least 1, with the dielectric substrate having a permittivity being adjustable.

As shown in FIG. 1, the grounding plane 112 also has a third side 1124 and a fourth side 1125, which are opposite to the first side 1122 and the second side 1123 respectively, with the first side 1122 and the fourth side 1125 forming the second angle 1126. An axis 1127 extends from the midpoint of the third side 1124 and the midpoint of the first side 1122, and the third radiation element 1113 and the fourth radiation element 1114 are disposed such that the third radiation element 1113 and the first radiation element 1111, and the fourth radiation element 1114 and the second radiation element 1112 are respectively one of a line symmetric pair and a mirror symmetric pair about the axis 1127.

Similarly, the third radiation element 1113 is connected to the first side 1122, and the fourth radiation element 1114 is connected (short-circuited) to the fourth side 1125 through the grounding metal piece 1142, with the distance between the grounding metal piece 1141 and the first angle 1121 being at least 1/61 of the wavelength in the free space corresponding to the lowest resonant frequency. And the distance between the grounding metal piece 1141 and the first angle 1121 is adjustable according to the antenna resonance patterns. Among them, the grounding metal piece 1141 has an area not exceeding ½ of that of the grounding plane 112, and the grounding metal piece 1141 preferably has a size of 2 mm×2 mm in the rectangular shape.

The distances among the first radiation element 1111, the second radiation element 1112, the third radiation element 1113 and the fourth radiation element 1114 are adjustable, and the first radiation element 1111, the second radiation element 1112, the third radiation element 1113 and the fourth radiation element 1114 have respective patterns being adjusted according to the resonant length of the operating frequency.

Figure 2:
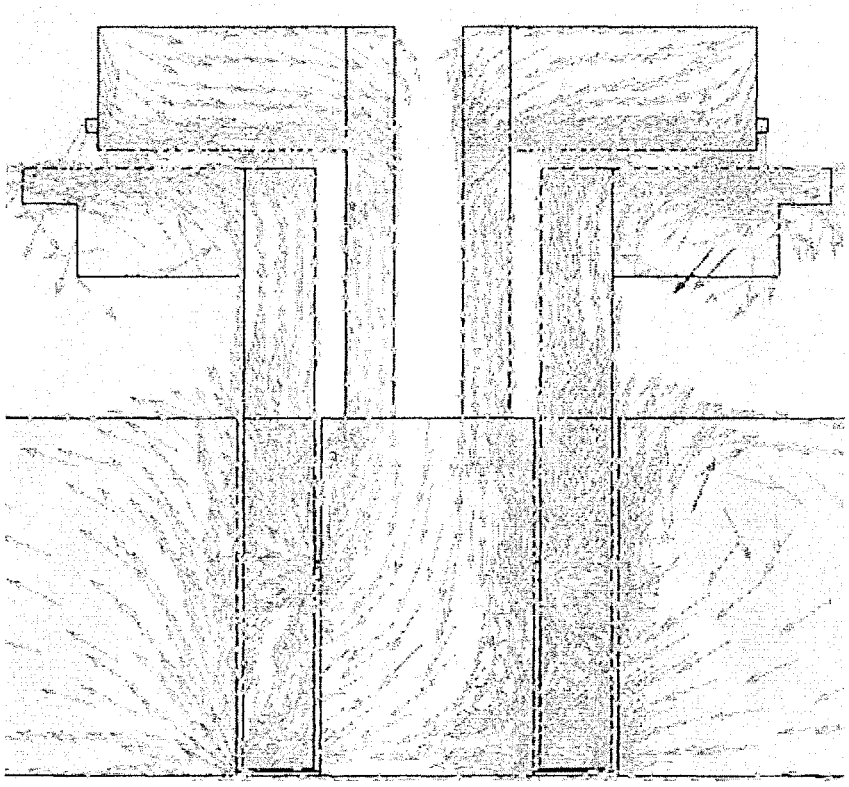
FIG. 2 shows the current path of the present invention's antenna device operating in the low-frequency band.
Figure 3:
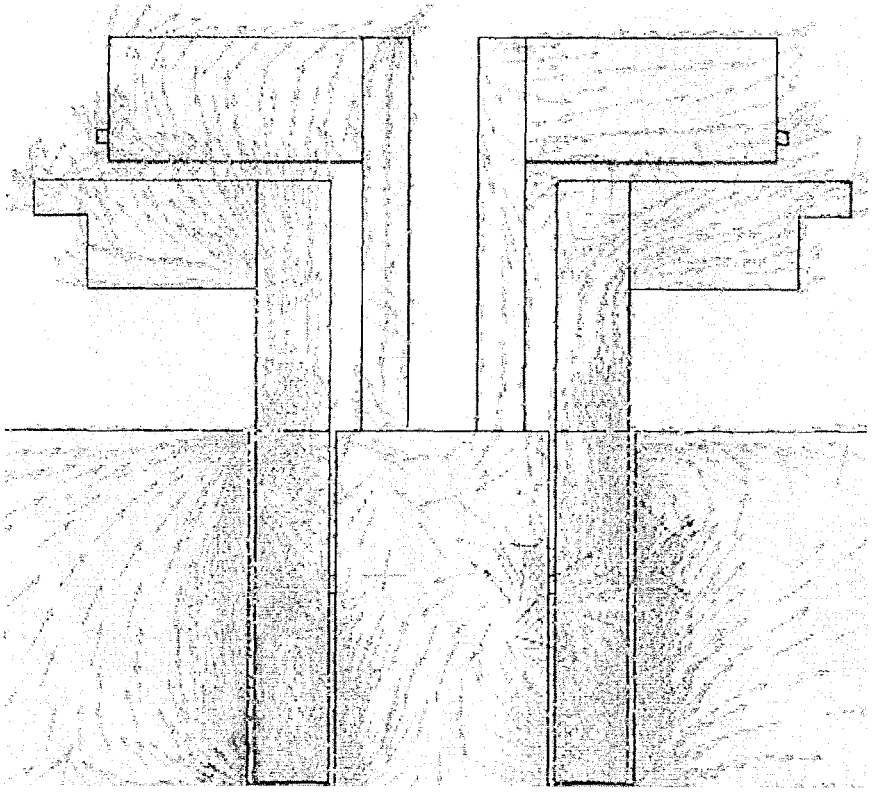
FIG. 3 shows the current path of the present invention's antenna device operating in the high-frequency band.

As stated by the above embodiment, the present invention provides a MIMO antenna with dual frequency isolation; the design which utilizes two grounding metal pieces enables the antenna to produce in the low-frequency and high-frequency bands two different resonance patterns, which are respectively the loop and inverted-F antenna (IFA). Through the characteristics of the current paths of the two resonance patterns, dual frequency isolation is achieved. Please refer to FIG. 2 and FIG. 3 for the current paths, with the arrows representing the directions of the currents, and the colors of the arrows representing current strength, the strength from strong to weak being: red (stronger)→yellow→green→blue (weaker). Between them FIG. 2 is the current path of the antenna operating in the low-frequency band, and FIG. 3 is the current path of the antenna operating in the high-frequency band. From FIG. 2 it can be seen that when the antenna operates in the low-frequency band, the current paths form loops respectively between the first radiation element 1111 and the second radiation element 1112 and between the third radiation element 1113 and the fourth radiation element 1114. From FIG. 3 it can be seen that when the antenna operates in the high-frequency band, the current paths form a zero point in the center of the grounding plane 114. As a result, there are good isolations in the high-frequency and low-frequency operations both between the antenna's first radiation element 1111 and the second radiation element 1112 and between the third radiation element 1113 and the fourth radiation element 1114.

Figure 4:
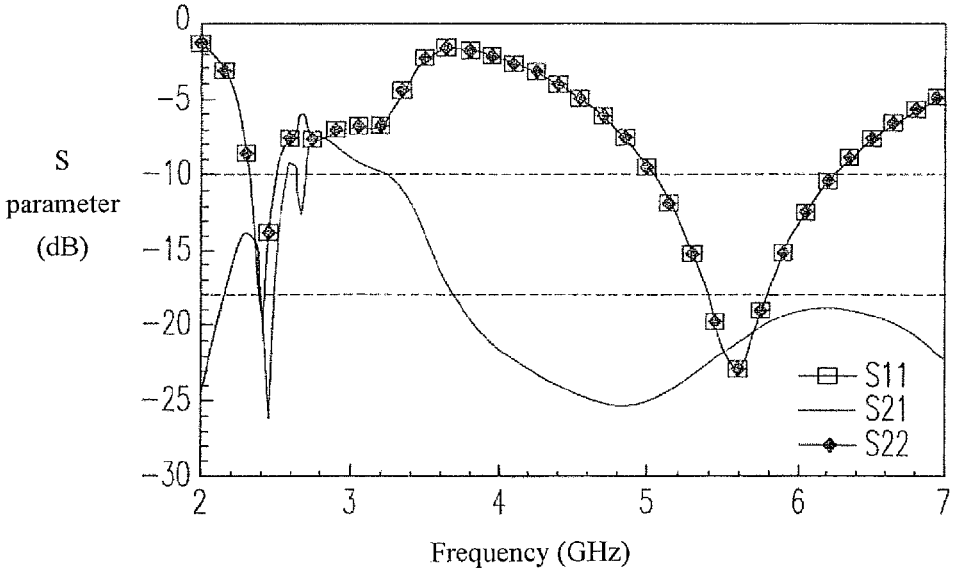
FIG. 4 shows the frequency response curves of the reflection coefficient and the isolation of the MIMO antenna according to the present invention obtained through simulation by a simulation software.

FIG. 4 shows the frequency response curves of the reflection coefficient and the isolation of the MIMO antenna according to the present invention obtained through simulation by a simulation software, where $S_{11}$ and $S_{22}$ represent respectively the reflection coefficients of the first antenna and the second antenna, and $S_{21}$ represents the coupling between the first antenna and the second antenna: the smaller of the value, the better the isolation between the two antennas. In general it is acceptable for the values of $S_{11}$ and $S_{22}$ not greater than −10 dB and for the value of $S_{21}$ not greater than −15 dB.

Figure 5:
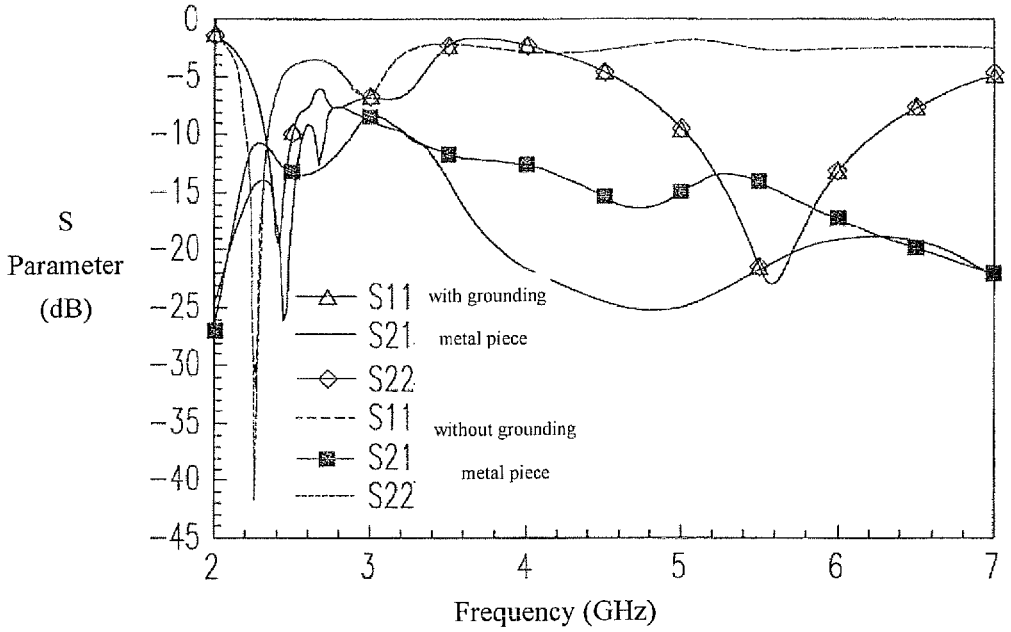
FIG. 5 shows the frequency response curves of the reflection coefficient and the isolation of the present invention obtained through simulation by a simulation software, and the frequency response curves of the reflection coefficient and the isolation without the grounding metal piece.

FIG. 5 shows the frequency response curves of the reflection coefficient and the isolation of the present invention obtained through simulation by a simulation software, and the frequency response curves of the reflection coefficient and the isolation without the grounding metal piece, where $S_{11}$ and $S_{22}$ represent the reflection coefficients, and $S_{21}$ represents the coupling between the two antennas. It can be seen from FIG. 5 that, the design with the grounding metal piece can produce a design of MIMO antenna with dual frequency isolation.

Figure 6:
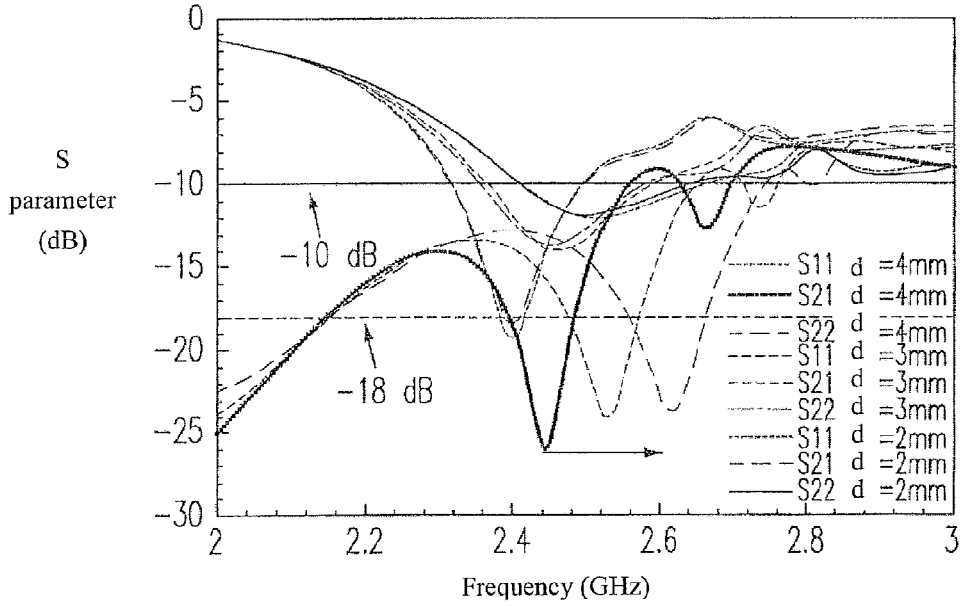
FIG. 6 shows the frequency response curves of the reflection coefficient and the isolation of the present invention for different distances between the two antennas obtained through simulation by a simulation software.

FIG. 6 shows the frequency response curves of the reflection coefficient and the isolation of the present invention for different distances between the two antennas obtained through simulation by a simulation software, where $S_{11}$ and $S_{22}$ represent the reflection coefficients, and $S_{21}$ represents the coupling between the two antennas.

Figure 7:
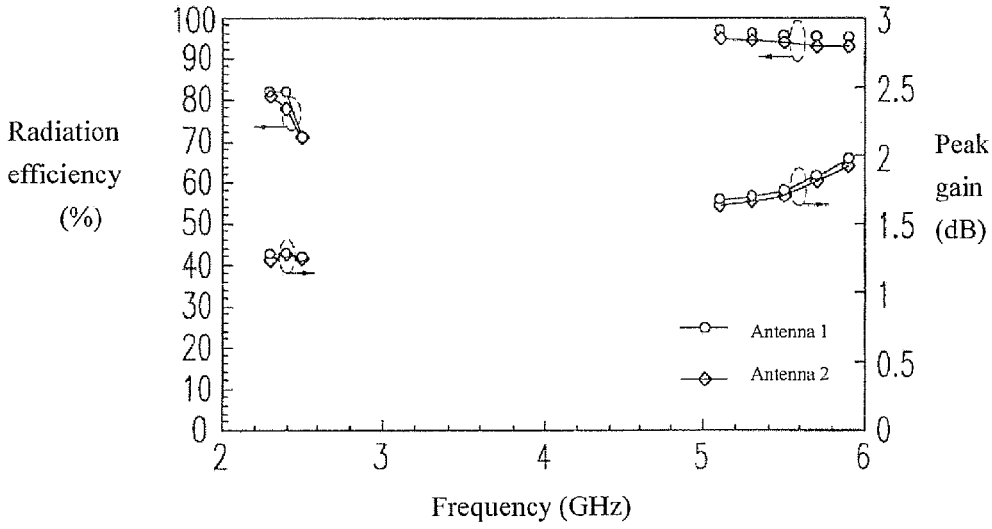
FIG. 7 is a figure showing the frequency response of the radiation efficiency and the peak gain.

FIG. 7 is a figure showing the frequency response of the radiation efficiency and the peak gain obtained through simulation by a simulation software, where the arrows point to the vertical axes for individual variables.

Figure 8:
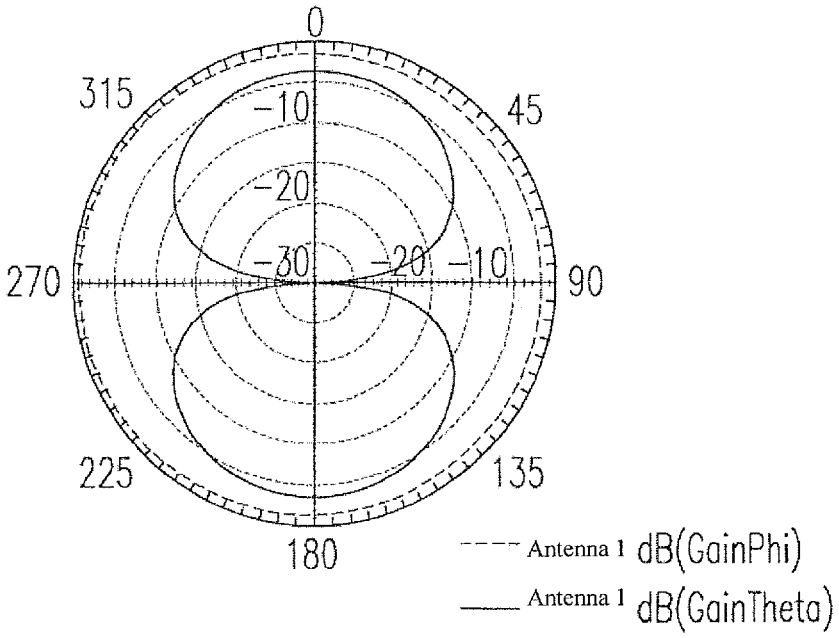
FIG. 8 to FIG. 15 are figures showing radiation patterns.
Figure 9:
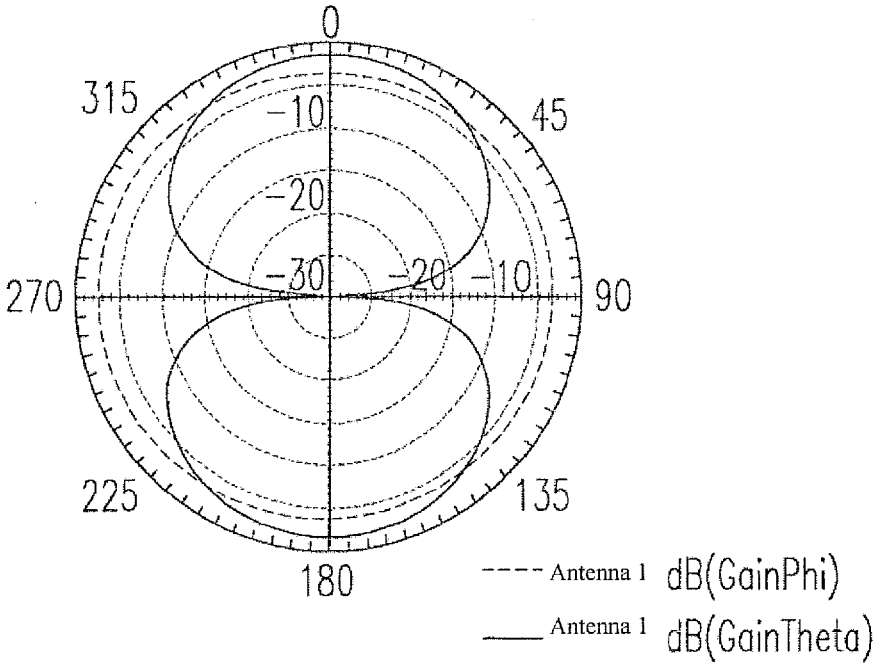

FIG. 8 and FIG. 9 are figures showing radiation patterns of the first antenna of the MIMO antenna of the present invention at 2.45 GHz.

Figure 10:
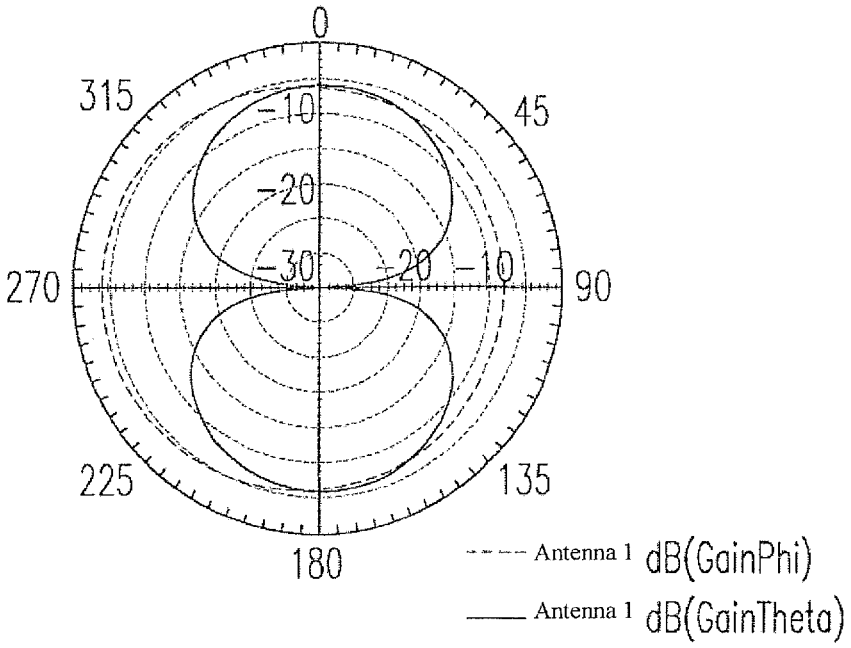
Figure 11:
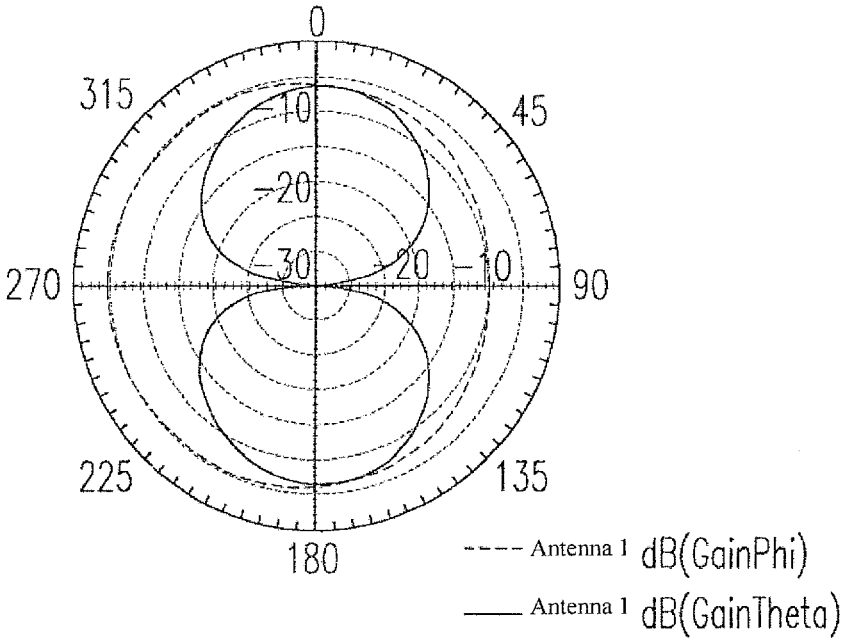

FIG. 10 and FIG. 11 are figures showing radiation patterns of the first antenna of the MIMO antenna of the present invention at 5.25 GHz.

Figure 12:
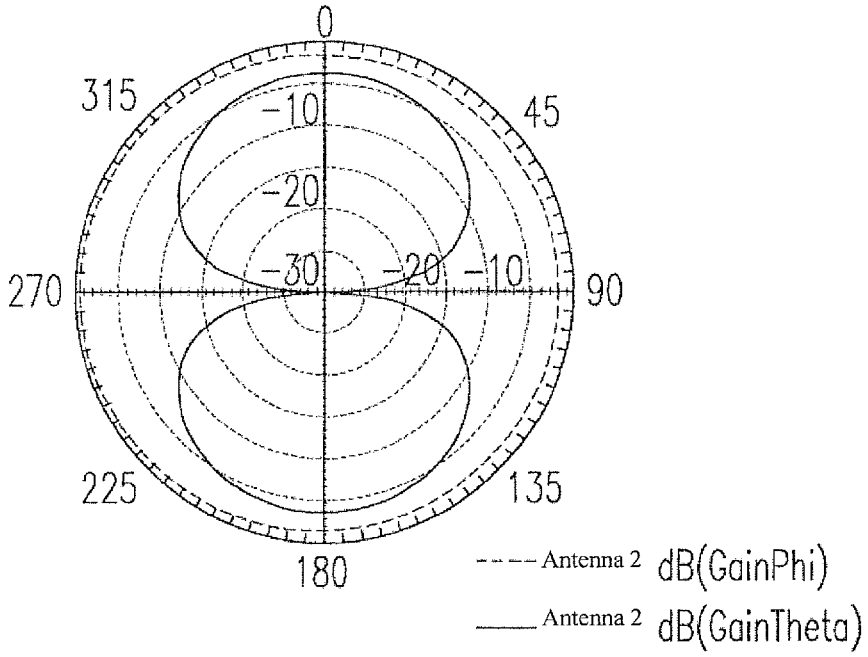
Figure 13:
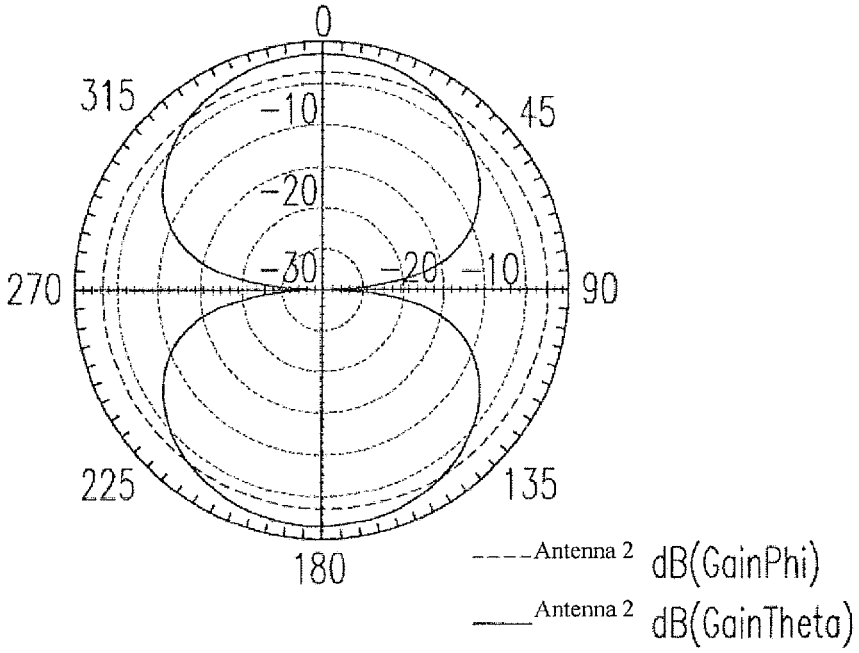

FIG. 12 and FIG. 13 are figures showing radiation patterns of the second antenna of the MIMO antenna of the present invention at 2.45 GHz.

Figure 14:
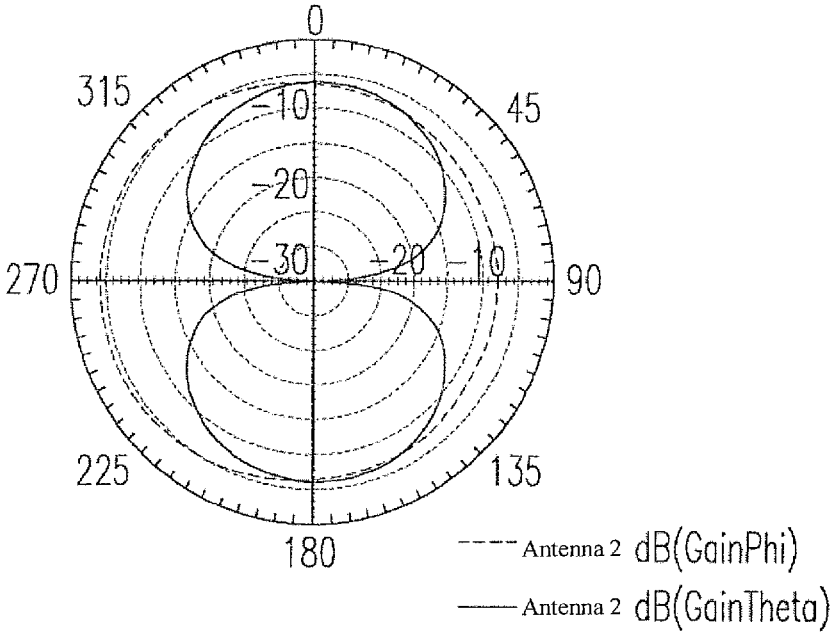
Figure 15:
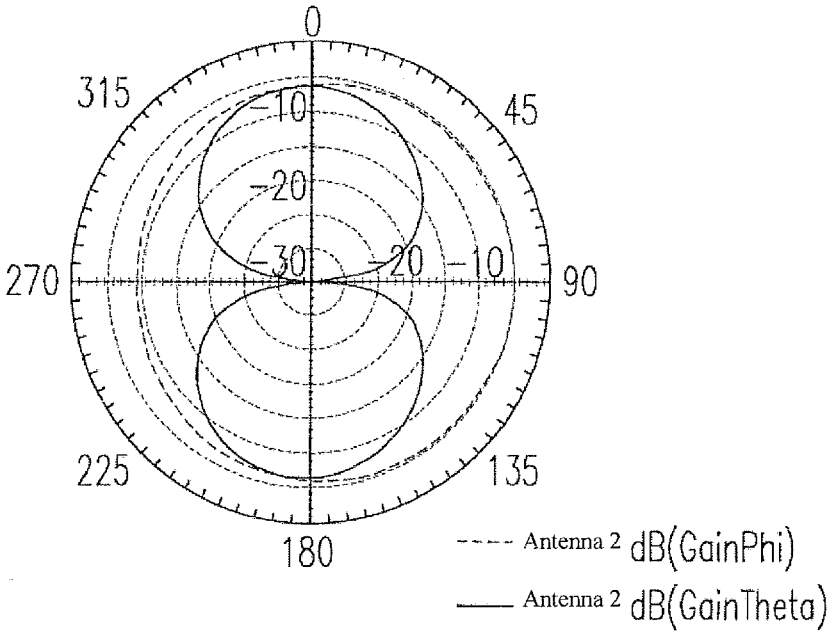

FIG. 14 and FIG. 15 are figures showing radiation patterns of the second antenna of the MIMO antenna of the present invention at 5.25 GHz.

The MIMO antenna of the present invention can be manufactured with the present printed circuit board (PCB) process. The process is simple, allowing the reduction of cost, and there is no need for complicated design of input network and additional decoupling circuit and structure. The MIMO antenna designed with two grounding metal pieces can produce an antenna device with dual frequency isolation. In the future 4G communication systems (LTE, WiMAX) already put MIMO technologies into the specifications. In view of the need for the MIMO antennas by the industry, and considering the MIMO antenna design within the limited space of a handheld device, the design of the present invention achieves good matching ($S_{11}$<−10 dB) and isolation ($S_{21}$<−18 dB) in the wireless local area network band (2.4~2.484 GHz) and 5.15~5.35 GHz when the distance between the two antennas is 2 mm ($0.016\lambda_0$).

There are further embodiments provided as follows.

Embodiment 1

A coplanar waveguide fed multiple-input multiple-output (MIMO) antenna device, includes a grounding metal piece; a grounding plane; a first radiation element connected to the grounding plane; and a second radiation element connected to the grounding plane through the grounding metal piece.

Embodiment 2

The coplanar waveguide fed MIMO antenna device as claimed in Embodiment 1 being one selected from a group consisting of a smart antenna, a single-input multiple-output (SIMO) antenna and a multiple-input single-output (MISO) antenna.

Embodiment 3

The coplanar waveguide fed MIMO antenna device as claimed in Embodiment 1 further includes a lowest resonant frequency in a free space, wherein the grounding plane has a rectangular shape, a first side and a second side adjacent to the first side and forming a first angle with the first side, the first radiation element is connected to the first side, the second radiation element is connected to the second side through the grounding metal piece.

Embodiment 4

The coplanar waveguide fed MIMO antenna device as claimed in Embodiment 3, wherein the distance between the grounding metal piece and the first angle is at least 1/61 of a wavelength in the free space corresponding to the lowest resonant frequency.

Embodiment 5

The coplanar waveguide fed MIMO antenna device as claimed in Embodiment 3 having a dielectric substrate with a total number of layers being at least 1, wherein each of the first radiation element and the second radiation element has an inverted L-shape.

Embodiment 6

The coplanar waveguide fed MIMO antenna device as claimed in Embodiment 5, wherein the dielectric substrate has a permittivity according to a desired radiation efficiency of the coplanar waveguide fed MIMO antenna device.

Embodiment 7

The coplanar waveguide fed MIMO antenna device as claimed in Embodiment 1 further includes a planar carrier, wherein the first radiation element and the second radiation element are disposed on the planar carrier through one being selected from a group consisting of a single-sided printed circuit board technique, a double-sided printed circuit board technique and an etching technique.

Embodiment 8

The coplanar waveguide fed MIMO antenna device as claimed in Embodiment 3 further includes a third and a fourth radiation elements, wherein the grounding plane has a third side with a first midpoint opposite to the first side with a second midpoint, an axis extends through the first midpoint and the second midpoint, and the third radiation element and the fourth radiation element are disposed such that the third and the first radiation elements and the fourth and the second radiation elements are respectively symmetric pairs about the axis.

Embodiment 9

The coplanar waveguide fed MIMO antenna device as claimed in Embodiment 8, wherein the distances among the first radiation element, the second radiation element, the third radiation element and the fourth radiation element are based on correlation coefficients among the first to the fourth radiation elements.

Embodiment 10

The coplanar waveguide fed MIMO antenna device as claimed in Embodiment 8 further includes an operating frequency and a corresponding resonant length, wherein the first radiation element, the second radiation element, the third radiation element and the fourth radiation element have respective patterns corresponding to the resonant length.

Embodiment 11

The coplanar waveguide fed MIMO antenna device as claimed in Embodiment 1, wherein the grounding metal piece has a size of 2 mm×2 mm.

Embodiment 12

The coplanar waveguide fed MIMO antenna device as claimed in Embodiment 1, wherein the grounding metal piece has an area not exceeding ½ of that of the grounding plane.

Embodiment 13

A multiple-input multiple-output antenna device, includes a grounding plane; a grounding piece; and at least two antennas connected separately to the grounding plane through the grounding piece and disposed on a plane coplanar with the grounding plane.

Embodiment 14

A multiple-input multiple-output antenna device, includes a grounding plane; a short-circuiting device; and at least two antennas, wherein at least one antenna of the at least two antennas is connected to the grounding plane through the short-circuiting device, and the at least one antenna is disposed on a plane coplanar with the grounding plane.

Embodiment 15

The multiple-input multiple-output antenna device as claimed in Embodiment 14, wherein the short-circuiting device is a grounding metal piece.

Embodiment 16

The multiple-input multiple-output antenna device as claimed in Embodiment 15, wherein the grounding metal piece has a size of 2 mm×2 mm.

Embodiment 17

The multiple-input multiple-output antenna device as claimed in Embodiment 15, wherein the grounding metal piece has an area not exceeding ½ of that of the grounding plane.

Embodiment 18

A method for manufacturing a multiple-input multiple-output antenna device, includes providing a grounding plane and at least two antennas; coplanarly disposing at least one antenna of the at least two antennas and the grounding plane; and causing the at least one antenna to be short-circuited to the grounding plane.

Embodiment 19

The method as claimed in Embodiment 18 further includes a step of providing a planar carrier for disposing the at least one antenna thereon.

Embodiment 20

The method as claimed in Embodiment 18 further includes a step of providing a grounding metal piece having an area not exceeding ½ of that of the grounding plane for connecting the at least one antenna to the grounding plane.

While the invention has been described in terms of what is presently considered to be the most practical and preferred embodiments, it is to be understood that the invention needs not be limited to the disclosed embodiments. Therefore, it is intended to cover various modifications and similar configuration included within the spirit and scope of the appended claims, which are to be accorded with the broadest interpretation so as to encompass all such modifications and similar structures.

What is claimed is:

1. A coplanar waveguide fed multiple-input multiple-output (MIMO) antenna device, comprising:

a first antenna;

a second antenna;

a first grounding metal piece;

a second grounding metal piece; and a grounding plane having a first side, a second side adjacent to the first side, a third side, and a fourth side non-adjacent to the second side, wherein the first antenna includes a first radiation element connected to the first side and a second radiation element connected to the second side through the first grounding metal piece, each of the first radiation element and the second radiation element has an inverted L-shape, the first radiation element and the second radiation element extend in the same direction, a portion of the second radiation element is located inside a rectangle including two adjacent sides formed by two inner adjacent edges of the first radiation element, and the second antenna is connected to the fourth side through the second grounding metal piece.

2. The coplanar waveguide fed MIMO antenna device as claimed in claim 1 being one selected from a group consisting of a smart antenna, a single-input multiple-output (SIMO) antenna and a multiple-input single-output (MISO) antenna.

3. The coplanar waveguide fed MIMO antenna device as claimed in claim 1 further comprising a lowest resonant frequency in a free space, wherein the grounding plane has a rectangular shape, and the second side forms a first angle with the first side.

4. The coplanar waveguide fed MIMO antenna device as claimed in claim 3, wherein the distance between the first grounding metal piece and the first angle is at least 1/61 of a wavelength in the free space corresponding to the lowest resonant frequency.

5. The coplanar waveguide fed MIMO antenna device as claimed in claim 3 having a dielectric substrate with a total number of layers being at least 1.

6. The coplanar waveguide fed MIMO antenna device as claimed in claim 5, wherein the dielectric substrate has a permittivity according to a desired radiation efficiency of the coplanar waveguide fed MIMO antenna device.

7. The coplanar waveguide fed MIMO antenna device as claimed in claim 3 further comprising a third and a fourth radiation elements, wherein the third side has a first midpoint opposite to the first side with a second midpoint, an axis extends through the first midpoint and the second midpoint, and the third radiation element and the fourth radiation element are disposed such that the third and the first radiation elements and the fourth and the second radiation elements are respectively symmetric pairs about the axis.

8. The coplanar waveguide fed MIMO antenna device as claimed in claim 7, wherein the distances among the first radiation element, the second radiation element, the third radiation element and the fourth radiation element are based on correlation coefficients among the first to the fourth radiation elements.

9. The coplanar waveguide fed MIMO antenna device as claimed in claim 7 further comprising an operating frequency and a corresponding resonant length, wherein the first radiation element, the second radiation element, the third radiation element and the fourth radiation element have respective patterns corresponding to the resonant length.

10. The coplanar waveguide fed MIMO antenna device as claimed in claim 1 further comprising a planar carrier, wherein the first radiation element and the second radiation element are disposed on the planar carrier through one being selected from a group consisting of a single-sided printed circuit board technique, a double-sided printed circuit board technique and an etching technique.

11. The coplanar waveguide fed MIMO antenna device as claimed in claim 1, wherein the first grounding metal piece has a size of 2 mm×2 mm.

12. The coplanar waveguide fed MIMO antenna device as claimed in claim 1, wherein the first grounding metal piece has an area not exceeding ½ of that of the grounding plane.

13. A multiple-input multiple-output antenna device, comprising:

a first antenna;

a second antenna;

a grounding plane having a first side, a second side adjacent to the first side, a third side, and a fourth side non-adjacent to the second side;

a first grounding piece; and a second grounding piece, wherein the first antenna includes a first radiation element connected to the first side and a second radiation element connected to the second side through the first grounding piece, each of the first radiation element and the second radiation element has an inverted L-shape, the first radiation element and the second radiation element extend in the same direction, a portion of the second radiation element is located inside a rectangle including two adjacent sides formed by two inner adjacent edges of the first radiation element, the second antenna is connected to the fourth side through the second grounding piece, and the first antenna and the second antenna are disposed on a plane coplanar with the grounding plane.

14. A multiple-input multiple-output antenna device, comprising:

a first antenna;

a second antenna;

a grounding plane having a first side, a second side adjacent to the first side, a third side, and a fourth side non-adjacent to the second side;

a first short-circuiting device; and a second short-circuiting device wherein the first antenna includes a first radiation element connected to the first side and a second radiation element connected to the second side through the first short-circuiting device, the second antenna is connected to the fourth side through the second short-circuiting device, each of the first radiation element and the second radiation element has an inverted L-shape, the first radiation element and the second radiation element extend in the same direction, a portion of the second radiation element is located inside a rectangle including two adjacent sides formed by two inner adjacent edges of the first radiation element, and at least one of the first antenna and the second antenna is disposed on a plane coplanar with the grounding plane.

15. The multiple-input multiple-output antenna device as claimed in claim 14, wherein the first short-circuiting device is a grounding metal piece.

16. The multiple-input multiple-output antenna device as claimed in claim 15, wherein the grounding metal piece has a size of 2 mm×2 mm.

17. The multiple-input multiple-output antenna device as claimed in claim 15, wherein the grounding metal piece has an area not exceeding ½ of that of the grounding plane.

18. A method for manufacturing a multiple-input multiple-output antenna device, comprising:

providing a first short-circuiting device, a second short-circuiting device, a grounding plane having a first side, a second side adjacent to the first side, a third side, and a fourth side non-adjacent to the second side, a first antenna comprising a first radiation element and a second radiation element, and a second antenna, wherein each of the first radiation element and the second radiation element has an inverted L-shape;

coplanarly disposing at least one of the first antenna and the second antenna and the grounding plane, wherein the first radiation element and the second radiation element extend in the same direction, and a portion of the second radiation element is located inside a rectangle including two adjacent sides formed by two inner adjacent edges of the first radiation element; and causing the first radiation element to be connected to the first side, the second radiation element to be short-circuited to the second side through the first short-circuiting device, and the second antenna to be short-circuited to the fourth side through the second short-circuiting device.

19. The method as claimed in claim 18 further comprising a step of providing a planar carrier for disposing the at least one of the first antenna and the second antenna thereon.

20. The method as claimed in claim 18, wherein the first short-circuiting device is a grounding metal piece having an area not exceeding ½ of that of the grounding plane.

* * * * *